US010119442B2

(12) United States Patent
Hwang

(10) Patent No.: US 10,119,442 B2
(45) Date of Patent: Nov. 6, 2018

(54) MUFFLER DEVICE INCLUDING CENTRAL COMMON ACTIVE CONTROL VALVE

(71) Applicant: Hyundai Motor Company, Seoul (KR)

(72) Inventor: Dae-Gil Hwang, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 42 days.

(21) Appl. No.: 15/355,458

(22) Filed: Nov. 18, 2016

(65) Prior Publication Data

US 2017/0276041 A1 Sep. 28, 2017

(30) Foreign Application Priority Data

Mar. 28, 2016 (KR) ..... 10-2016-0036535

(51) Int. Cl.

| | |
|---|---|
| ***F01N 1/16*** | (2006.01) |
| ***F01N 1/08*** | (2006.01) |
| ***G10K 11/16*** | (2006.01) |
| ***F01N 13/04*** | (2010.01) |
| ***F01N 13/08*** | (2010.01) |

(52) U.S. Cl.

CPC ..... *F01N 1/165* (2013.01); *F01N 1/083* (2013.01); *F01N 1/163* (2013.01); *F01N 1/168* (2013.01); *F01N 13/04* (2013.01); *F01N 13/082* (2013.01); *G10K 11/161* (2013.01); *F01N 2240/36* (2013.01)

(58) Field of Classification Search

CPC ..... F01N 1/165; F01N 1/168; F01N 1/163; F01N 13/14; F01N 2240/36; F01N 1/083; F01N 13/082; G10K 11/161

USPC ..... 181/237, 238, 254

See application file for complete search history.

(56) References Cited

U.S. PATENT DOCUMENTS

| | | | | |
|---|---|---|---|---|
| 4,869,063 | A * | 9/1989 | Sakurai | F02B 27/06 60/313 |
| 6,209,318 | B1 * | 4/2001 | Rutschmann | F02B 27/06 60/312 |
| 6,755,279 | B2 * | 6/2004 | Kaneko | F01N 1/089 181/212 |
| 6,938,729 | B2 * | 9/2005 | Worner | F01N 1/166 181/232 |
| 7,686,130 | B1 * | 3/2010 | Quaglia | F01N 13/087 180/309 |
| 8,418,445 | B2 * | 4/2013 | Laube | F01N 1/00 181/238 |

(Continued)

FOREIGN PATENT DOCUMENTS

| | | |
|---|---|---|
| JP | 5-27222 U | 4/1993 |
| JP | 6-29548 B2 | 4/1994 |

(Continued)

*Primary Examiner* — Forrest M Phillips

(74) *Attorney, Agent, or Firm* — Morgan, Lewis & Bockius LLP

(57) ABSTRACT

A muffler assembly including a central common active control valve may include a central body for guiding exhaust gas discharged from an engine to flow in bilateral directions in a branched manner, the central body comprising the active control valve disposed in a flow path of exhaust gas, and a pair of main mufflers, each separately disposed at opposite sides of the central body to exhaust exhaust gas introduced from the central body, in which the flow path and an exhaust path of the exhaust gas may be variable based on opening and closing of the active control valve.

10 Claims, 5 Drawing Sheets

(56) References Cited

U.S. PATENT DOCUMENTS

| | | | | |
|---|---|---|---|---|
| 8,826,651 | B2 * | 9/2014 | Laube | F01N 1/166<br>181/211 |
| 2006/0162995 | A1 * | 7/2006 | Schorn | F01N 1/006<br>181/237 |
| 2008/0302597 | A1 * | 12/2008 | Kruger | F01N 13/02<br>181/238 |

FOREIGN PATENT DOCUMENTS

| | | | |
|---|---|---|---|
| JP | 2519596 | B2 | 5/1996 |
| JP | 2001-329837 | A | 11/2001 |
| JP | 2015-175337 | A | 10/2015 |
| KR | 10-1998-038488 | A | 8/1998 |

* cited by examiner

MUFFLER DEVICE INCLUDING CENTRAL COMMON ACTIVE CONTROL VALVE

CROSS-REFERENCE TO RELATED APPLICATION

The present application claims priority to Korean Patent Application No. 10-2016-0036535, filed Mar. 28, 2016, the entire contents of which is incorporated herein for all purposes by this reference.

BACKGROUND OF THE INVENTION

Field of the Invention

The present invention relates to a muffler assembly equipped with an active control valve for a vehicle, and more particularly, to a muffler assembly including two main mufflers separate from each other, and an active control valve centrally disposed between the main mufflers, thereby being capable of achieving an effect exhibited when two active control valves are used, using one active control valve.

Description of Related Art

Generally, exhaust gas burning in an engine of a vehicle has a significantly high temperature. Furthermore, velocity of exhaust gas is almost equal to sonic velocity. When such exhaust gas is directly exhausted into the atmosphere, exhaust gas generates an intense explosion sound while expanding abruptly. To this end, a separate muffler is installed in an exhaust gas path in the vehicle to lower the temperature and pressure of exhaust gas, thereby reducing exhaust noise.

FIG. 1 is a view illustrating a conventional muffler installed in a vehicle, and FIG. 2 is a view illustrating an active control valve additionally installed in the conventional muffler.

As illustrated in FIG. 1, an exhaust pipe 1 is connected to an exhaust manifold of an engine to guide flow of exhaust gas. Coupled to the exhaust pipe 1 are a catalytic converter 2 for converting harmful substances contained in exhaust gas into harmless substances and a muffler 3 for decreasing exhaust noise.

In this case, as illustrated in FIG. 2, tailpipes 4 discharge exhaust gas passing though the muffler 3 to an outside. Additionally, an active control valve 5 is mounted in one of the tailpipes 4 to change an exhaust path of exhaust gas in accordance with driving conditions of the vehicle.

In detail, during a constant or low engine speed period, the active control valve 5 is closed, such that exhaust gas is exhausted through only one tailpipe 4, in which the active control valve 5 is not mounted. On the other hand, during an accelerating or high engine speed period, the active control valve 5 is opened, such that exhaust gas is exhausted through both of the tailpipes 4.

The illustrated case shows an example in which two tailpipes 4 are coupled to the muffler 3 and one active control valve 5 is used. However, when four tailpipes are coupled to the muffler, two active control valves may be used. As the number of the active control valves is increased, there is an advantage in that variation of exhaust pressure and exhaust tone of exhaust gas may be maximized.

The active control valve 5 is used as a muffler tuning element for high performance vehicles capable of differentiating exhaust pressure and exhaust tone of exhaust gas. However, this tuning element is considerably expensive and, as such, there may be a limitation in increasing the number of active control valves 5.

Furthermore, as illustrated in FIG. 2, a branch chamber 3*a* of the muffler 3 functions only to bilaterally transfer exhaust gas. In this case, the branch chamber 3*a* is not a volume for expansion, resonance, and sound absorption used for tuning of the muffler 3 and, as such, the branch chamber 3*a* may be a dead space due to low space utilization.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a muffler assembly including a central common active control valve, which is capable of achieving an effect exhibited when two active control valves are used, using one active control valve centrally disposed between two main mufflers.

Additionally, various aspects of the present invention are directed to providing a muffler assembly including a central common active control valve, in which after a conventional branch chamber, a dead space, is eliminated and, as such, a central body including the active control valve is configured in a space formed by virtue of elimination of the branch chamber. Accordingly, there are advantages in terms of space utilization and manufacturing costs.

According to various aspects of the present invention, a muffler assembly including a central common active control valve may further include a central body for guiding exhaust gas discharged from an engine to flow in bilateral directions in a branched manner, the central body comprising the active control valve disposed in a flow path of exhaust gas, and a pair of main mufflers, each separately disposed at opposite sides of the central body to exhaust exhaust gas introduced from the central body, in which the flow path and an exhaust path of the exhaust gas may be variable based on opening and closing of the active control valve.

The central body may further include a branch part connected to the pair of main mufflers through a pair of first insert pipes, the pair of first insert pipes bilaterally expanding, and a branch chamber connected to a rear end of the branch part, the branch chamber connected to the pair of main mufflers through a pair of second insert pipes, the pair of second insert pipes bilaterally extending, in which the active control valve may be disposed between the branch part and the branch chamber.

The branch part and the pair of first insert pipes bilaterally extending from the branch part may be connected to form a cross shape, and the branch chamber connected to a front end of the branch part and the pair of second pipes extending from the branch chamber may be connected to form an inverted "Y" shape.

Each of the main mufflers may include a plurality of baffles laterally coupled in the main muffler and dividing an inner space of the main muffler, a first tube extending through the baffles, disposed in the inner space of the main muffler, and connected to a corresponding one of the first insert pipes, and a second tube extending through the baffles, disposed in the inner space of the main muffler, and connected to a corresponding one of the second insert pipes.

The muffler assembly may further include a first tailpipe for exhausting exhaust gas transferred from the first tube to an outside, one end of the first tailpipe being connected to the first tube, and a second tailpipe for exhausting exhaust gas transferred from the second tube to the outside, one end of the second tailpipe being connected to the second tube.

When the active control valve is closed, exhaust gas may be exhausted through the first insert pipe, the first tube and the first tailpipe to the outside, and when the active control valve is opened, exhaust gas may be exhausted through the first insert pipe, the first tube, the first tailpipe, the second insert pipe, the second tube and the second tailpipe to the outside.

The active control valve may be selectively opened and closed based on at least one of engine revolutions per minute (RPM), engine load, and vehicle speed determined by a controller.

The active control valve may be closed when the engine RPM is between a first predetermined RPM and a second predetermined RPM and the engine load is less than a predetermined engine load.

The active control valve may be opened when the engine RPM is less than a first predetermined RPM or greater than a second predetermined RPM.

The active control valve may be opened when the engine load is greater than a predetermined engine load.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 3:
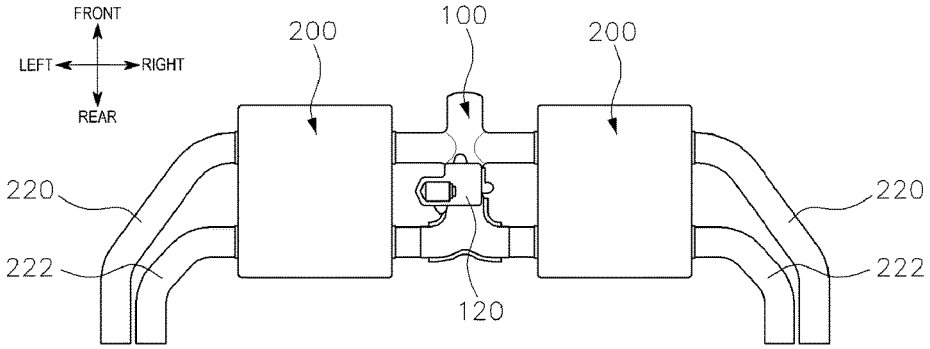
FIG. 3 is a view illustrating a muffler assembly including a central common active control valve according to various embodiments of the present invention.

FIG. 3 is a view illustrating a muffler assembly including a central common active control valve according various embodiments of the present invention.

As illustrated in FIG. 3, the muffler assembly including the central common active control valve according to various embodiments of the present invention includes a central body 100 for guiding exhaust gas discharged from an engine to flow in bilateral directions in a branched manner, while including the active control valve 120 installed in a flow path of exhaust gas, and a pair of mufflers 200 separately disposed at opposite lateral sides of the central body 100, respectively, while exhausting exhaust gas introduced from the central body 100 to an outside.

Figure 1:
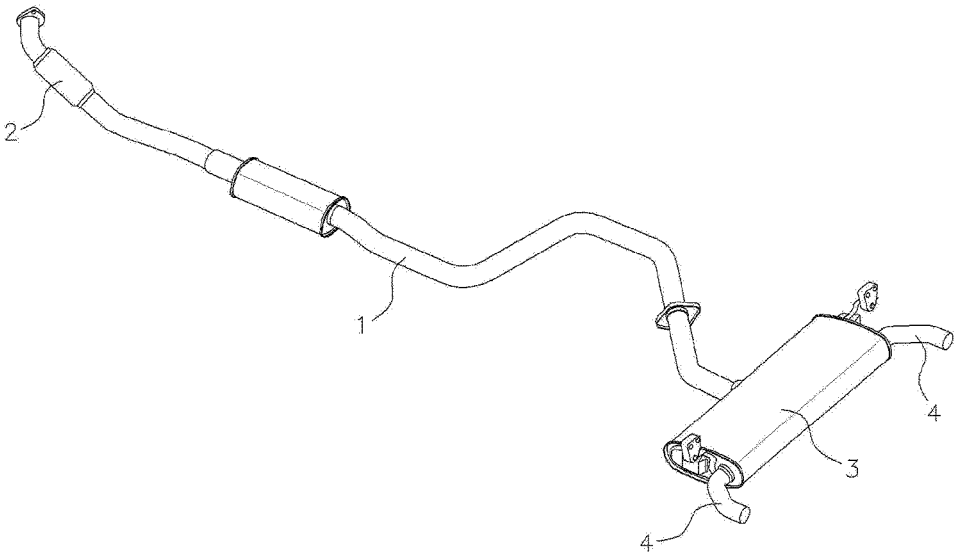
FIG. 1 (PRIOR ART)
FIG. 1 is a view illustrating a conventional muffler installed in a vehicle.

Similar to conventional cases, exhaust gas discharged from the engine flows through an exhaust manifold, a catalytic convertor 2 (in FIG. 1), an exhaust pipe 1 (in FIG. 1), and so on, in order to be transferred to the central body 100. This exhaust gas bilaterally branches off from the central body 100 and is introduced into the main mufflers 200, respectively. In addition, exhaust gas in the main mufflers 200 is exhausted through tailpipes 220 and 222 under the condition that the temperature and pressure of exhaust gas have been lowered.

Figure 2:
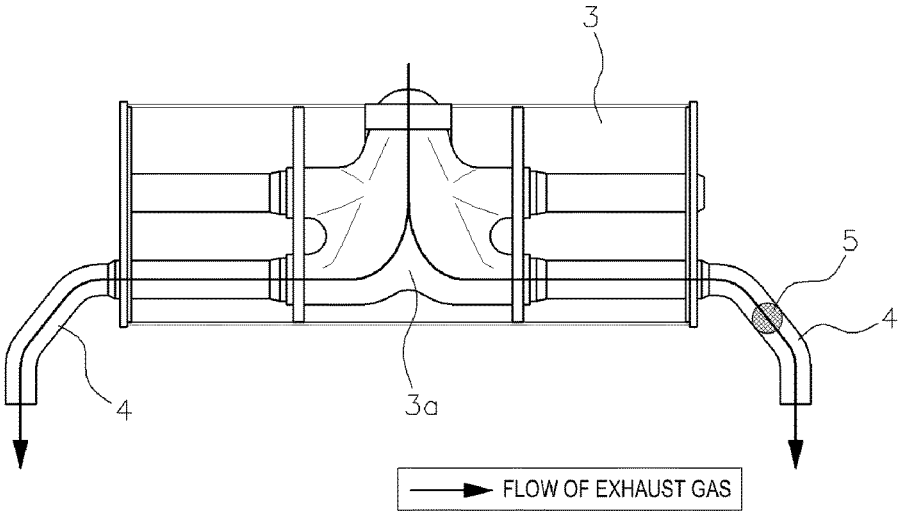
FIG. 2 (PRIOR ART)
FIG. 2 is a view illustrating an active control valve additionally installed in the conventional muffler.

As mentioned above, the conventional active control valve 5 (in FIG. 2) is mounted in one of the tailpipes 4 (in FIG. 2) of the vehicle. However, the active control valve 120 of various embodiments of the present invention is installed at the central body 100 between the pair of main mufflers 200. In addition, the flow and exhaust paths of exhaust gas are variable in accordance with opening/closing of the active control valve 120.

As the active control valve 120 is installed at the central body 100, as described above, space utilization is maximized without a loss of a tuning volume of noise, vibration and harshness (NVH) used for expansion, resonance, and sound absorption.

When the size of the main mufflers 200 is decreased in forward and rearward directions in order to apply the active control valve 120 at the rear of rear wheels, the volume of expansion, resonance, and sound absorption is decreased and, as such, the degree of freedom for NVH tuning volume is limited and it is difficult to configure an additional tailpipe.

Figure 4:
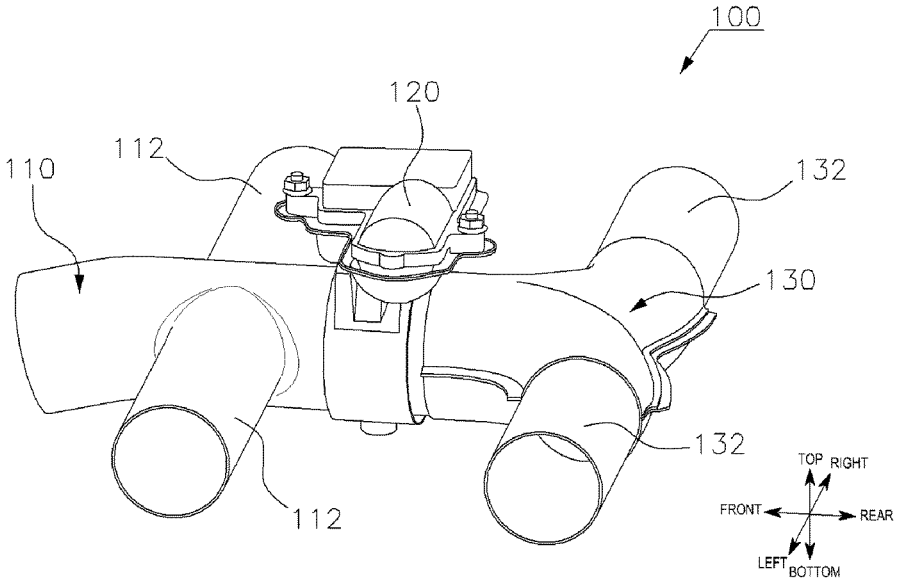
FIG. 4 is a perspective view illustrating the central body according to various embodiments of the present invention.

FIG. 4 is a perspective view illustrating the central body according to various embodiments of the present invention.

As illustrated in FIG. 4, the central body 100 includes a branch part 110 connected to the pair of main mufflers 200 through a pair of first insert pipes 112 bilaterally extending from the branch part 110, and a branch chamber 130 connected to a rear end of the branch part 110 while being respectively connected to the pair of main mufflers 200 through a pair of second insert pipes 132 extending from the branch chamber 130.

In this case, the active control valve 120 is installed between the branch part 110 and the branch chamber 130 to allow or prevent flow of exhaust gas toward the branch chamber 130. Accordingly, the flow path of exhaust gas is variable.

That is, exhaust gas discharged from the engine of the vehicle is transferred through the exhaust pipe to the branch part 110 and the exhaust chamber 130. Exhaust gas is then transferred through the branch part 110 and the exhaust chamber 130 to the main mufflers 200. When the active control valve 120 is closed, exhaust gas is transferred only through the branch part 110, whereas when the active control valve 120 is opened, exhaust gas is transferred through both the branch part 110 and the branch chamber 130.

As illustrated in FIG. 4, the branch part 110 and the first insert pipes 112 bilaterally extending from the branch part 110 are connected to form a cross shape ("+"). In this case, a front end of the branch part 110 is connected to the exhaust pipe 1 (in FIG. 1) and the rear end of the branch part 110 is connected to the branch chamber 130.

A front end of the branch chamber 130 is connected to the branch part 110. The branch chamber 130 and the second insert pipes 132 extending from the branch chamber 130 are connected to form an inverted "Y" shape. Furthermore, the active control valve 120 is installed between the rear end of the branch part 110 and the front end of the branch chamber 130.

The branch part 110, the first insert pipes 112, the branch chamber 130, and the second insert pipes 132 may be manufactured as separate elements to be assembled or may be formed in an integrated structure. In addition, these elements may have diameters or lengths in various types taking into consideration a kind or layout of the vehicle.

Figure 5:
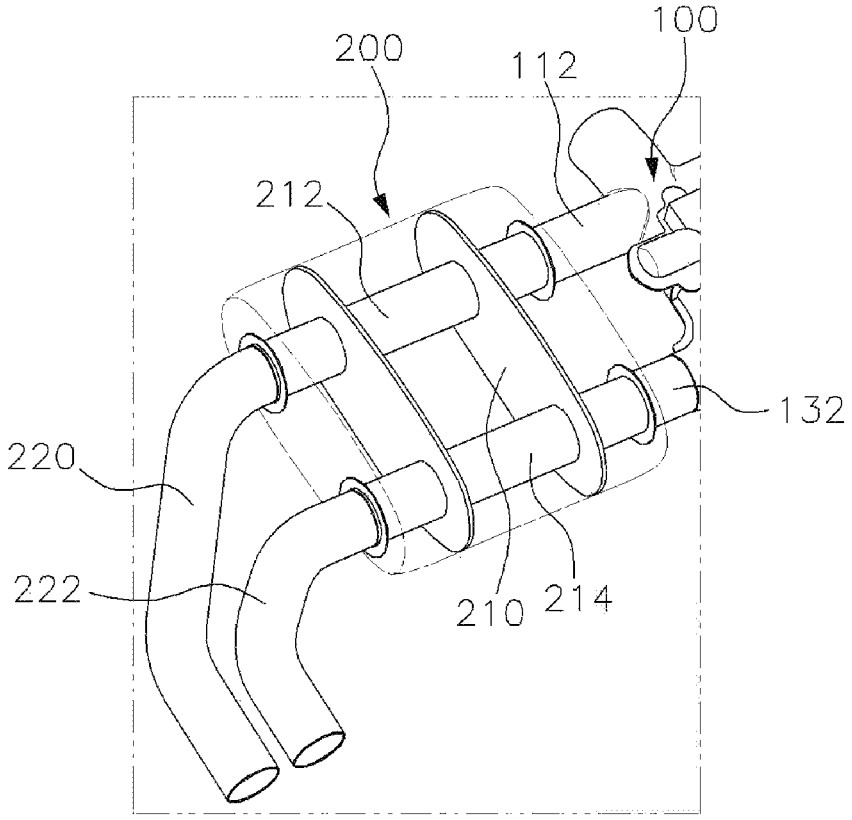
FIG. 5 is a view illustrating a structure of main mufflers and tailpipes according to various embodiments of the present invention.

FIG. 5 is a view illustrating structures of the main mufflers and tailpipes according to various embodiments of the present invention.

As illustrated in FIG. 5, each main muffler 200 includes a plurality of baffles 210 laterally coupled in the main muffler 200 to divide an inner space of the main muffler 200, a first tube 212 extending through the baffles 210 while being disposed in the inner space of the main muffler 200 and connected to a corresponding one of the first insert pipes 112, and a second tube 214 extending through the baffles 210 while being disposed in the inner space of the main muffler 200 and connected to a corresponding one of the second insert pipes 132.

In various embodiments, two baffles 210 are provided to divide the inner space of the main muffler 200 into three spaces. The first and second tubes 212 and 214 of the main mufflers 200 are disposed at left and right sides of the vehicle while extending through the corresponding baffles 210.

FIG. 5 illustrates a structure of one of the main mufflers 200, that is, the main muffler 200 disposed at the left side of the vehicle. However, a person skilled in the art may readily understand that the main muffler 220 disposed at the right side of the vehicle has a structure identical or similar to the structure of the left main muffler 200.

Furthermore, a first tailpipe 220 and a second tailpipe 222 are disposed outside of each main muffler 200. One end of the first tailpipe 220 is connected to the first tube 212 to discharge exhaust gas transferred from the first tube 212. One end of the second tailpipe 222 is connected to the second tube 214 to discharge exhaust gas transferred from the second tube 214.

The first tailpipe 220 and the second tailpipe 222 function to exhaust, to the outside, exhaust gas, which has been lowered in temperature and pressure while passing through the main muffler 200, thereby generating reduced exhaust noise. Unlike the conventional muffler, the active control valve 120 is not installed in any one of the first tailpipe 220 and the second tailpipe 222.

Figure 6:
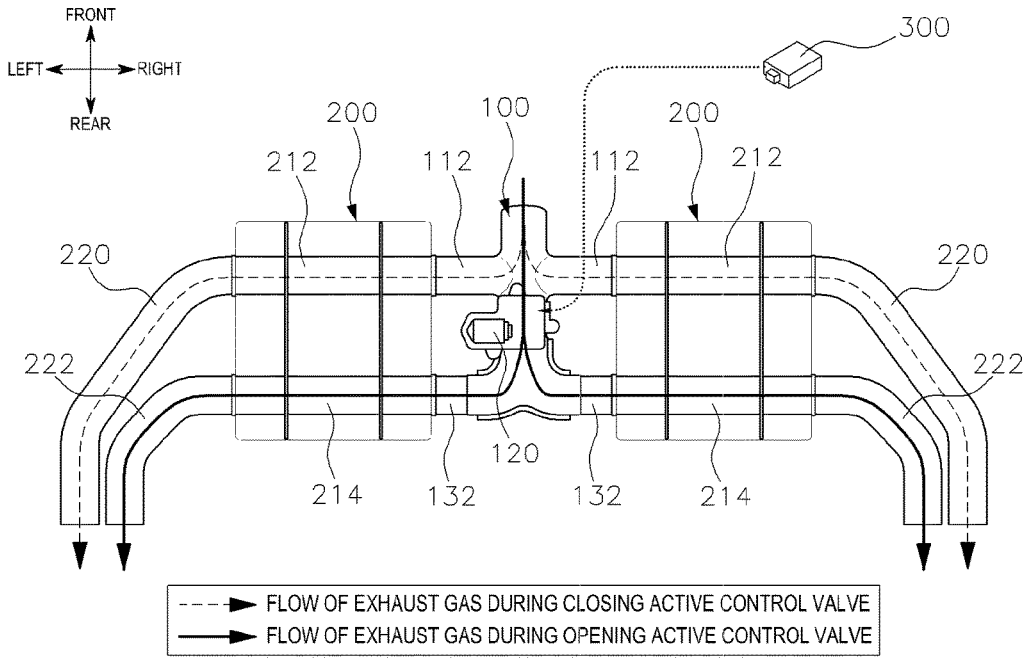
FIG. 6 is a view illustrating flow and exhaust paths of exhaust gas through the muffler assembly including the central common active control valve according to various embodiments of the present invention.

FIG. 6 is a view illustrating the flow and exhaust paths of exhaust gas through the muffler assembly including the central common active control valve according to various embodiments of the present invention.

As illustrated, when the active control valve 120 is closed, exhaust gas is exhausted from two exhaust outlets through the first insert pipes 112, the first tubes 212, and the first tailpipes 220.

When the active control valve 120 is opened, exhaust gas is exhausted from four exhaust outlets through the first insert pipes 112, the first tubes 212, the first tailpipes 220, the second insert pipes 132, the second tubes 214, and the first tailpipes 222.

Accordingly, various embodiments of the present invention have an advantage in that using one active control valve 120, it is possible to obtain an effect equal or similar to an effect obtained when two active control valves are installed and, as such, variation in exhaust pressure and exhaust tone of exhaust gas may be maximized in accordance with driving conditions of the vehicle.

In this case, the active control valve 120 is opened or closed in accordance with at least one of an engine revolutions per minute (RPM), an engine load (measure: %), and a vehicle speed (measure: km/h), which is recognized by a controller 300.

An electronic control unit (ECU) of the vehicle may be used as the controller 300. Alternatively, a separate controller may be used to open/close the central common active control valve 120 according to various embodiments of the present invention.

Here, the engine RPM means the rate of revolutions of the engine. As the rate of revolutions is increased, output power and velocity of the vehicle are generally increased. The engine load representing the working intensity of the engine is closely associated with an opening degree of a throttle valve (air amount). The engine load is categorized into calculated engine load and absolute engine load. A percentage (%) is a measure of the engine load. The vehicle velocity is a value measured by a vehicle speed sensor.

Figure 7:
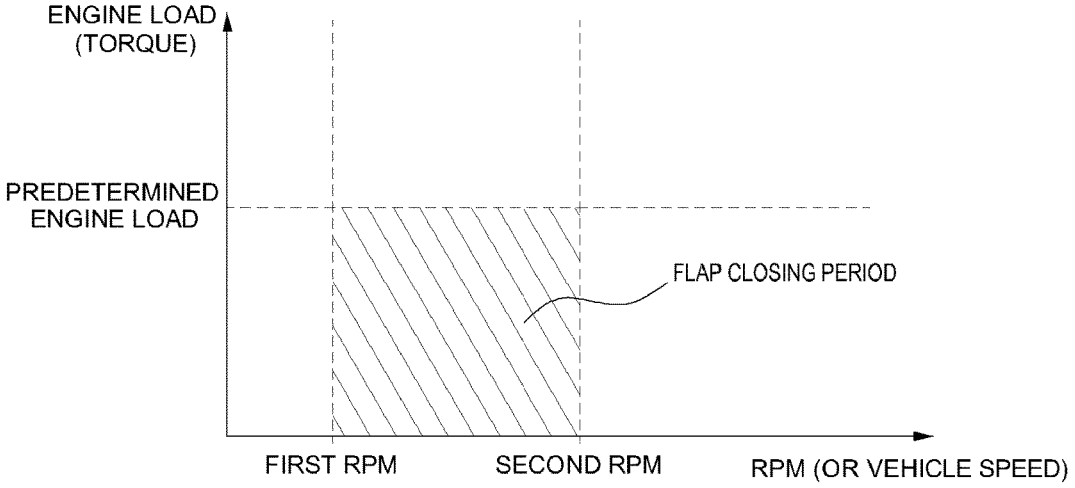
FIG. 7 is a graph of an operation period of the active control valve according to various embodiments of the present invention.

FIG. 7 is a graph illustrating an operation period of the active control valve according to various embodiments of the present invention.

The active control valve 120 according to various embodiments of the present invention may be closed when the engine RPM is between a first predetermined RPM and a second predetermined RPM and the engine load is less than predetermined engine load. This refers as to a flap closing period and corresponds to a hatched area in FIG. 7.

The first predetermined RPM, the second predetermined RPM and the predetermined engine load may be determined to be various values reflecting a kind of the vehicle, a required standard of exhaust noise, user demand, and so on. The following description will be given in conjunction with an example of the present invention, in which the first predetermined RPM is 750 RPM, the second predetermined RPM is 3,000 RPM, and the predetermined engine load is 50%.

The flap closing period corresponds to a low or constant engine speed period or a low engine load period. The flap closing period is a period in which a sense of quietness is preferentially required and, as such, the active control valve 120 is closed to discharge exhaust gas only through the first tailpipes 220, namely, two exhaust outlets.

Meanwhile, as illustrated in FIG. 7, in periods other than the flap closing period, the active control valve 120 is opened. In detail, the active control valve 120 is opened when the engine RPM is less than the first predetermined RPM (750 RPM) or is greater than the second predetermined RPM (3,000 RPM). The active control valve 120 may be opened when the engine load is equal to or greater than 50%.

Such a period corresponds to a high engine speed period, an acceleration/retardation period, or a high engine load period. In these periods, a sense of power is preferentially required and, as such, the active control valve 120 is opened to discharge exhaust gas through the first tailpipes 220 and the second tailpipes 222, namely, four exhaust outlets.

The period in which the engine RPM is less than the first predetermined RPM (750 RPM) is an idle period. In the case of a high performance vehicle, the active control valve 120 is opened at the idle period just before starting the vehicle in order to implement power with a rough exhaust tone. In this period, exhaust gas is exhausted through the four exhaust outlets.

The main mufflers 200 are disposed at opposite lateral sides of the central body 100, while being separated from each other, the central body 100 is equipped with the active control valve 120 and, as such, it is possible to obtain an effect equal or similar to an effect obtained when two active control valves are installed.

In detail, when the active control valve 120 is closed, exhaust gas is exhausted through two exhaust outlets (a pair of first tailpipes), whereas when the active control valve 120 is opened, exhaust gas is exhausted through four exhaust outlets (a pair of first tailpipes and a pair of second pipes). There is an advantage in that variation of the exhaust pressure and exhaust tone is maximized in accordance with driving conditions of the vehicle.

Furthermore, the number of active control valves 120, an expensive tuning element for a muffler, may be decreased and, as such, there are advantages in terms of manufacturing costs and weight. Furthermore, the conventional branch chamber (e.g., chamber 3*a* in FIG. 2), a dead space, is eliminated and, as such, the central body 100 including the active control valve 120 may be configured in a space formed by virtue of elimination of the branch chamber. Accordingly, there is an advantage in terms of space utilization.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler assembly including a central common active control valve, comprising:

a central body for guiding exhaust gas discharged from an engine through one exhaust pipe to flow in bilateral directions in a branched manner therefrom, the central body comprising the active control valve disposed in a flow path of exhaust gas supplied through the one exhaust pipe to exhaust the exhaust gas in the bilateral directions in the branched manner; and a pair of main mufflers, each separately disposed at opposite sides of the central body to exhaust exhaust gas introduced from the central body, wherein the flow path and an exhaust path of the exhaust gas are variable based on opening and closing of the active control valve.

2. The muffler assembly according to claim 1, wherein the central body further comprises:

a branch part connected to the pair of main mufflers through a pair of first insert pipes, the pair of first insert pipes bilaterally expanding; and a branch chamber connected to a rear end of the branch part, the branch chamber connected to the pair of main mufflers through a pair of second insert pipes, the pair of second insert pipes bilaterally extending, wherein the active control valve is disposed between the branch part and the branch chamber.

3. The muffler assembly according to claim 2, wherein the branch part and the pair of first insert pipes bilaterally extending from the branch part are connected to form a cross shape; and the branch chamber connected to a front end of the branch part and the pair of second pipes extending from the branch chamber are connected to form an inverted "Y" shape.

4. The muffler assembly according to claim 2, wherein each of the main mufflers comprises:

a plurality of baffles laterally coupled in the main muffler and dividing an inner space of the main muffler;

a first tube extending through the baffles, disposed in the inner space of the main muffler, and connected to a corresponding one of the first insert pipes; and a second tube extending through the baffles, disposed in the inner space of the main muffler, and connected to a corresponding one of the second insert pipes.

5. The muffler assembly according to claim 4, further comprising:

a first tailpipe for exhausting exhaust gas transferred from the first tube to an outside, a first end of the first tailpipe being connected to the first tube; and a second tailpipe for exhausting exhaust gas transferred from the second tube to the outside, a first end of the second tailpipe being connected to the second tube.

6. The muffler assembly according to claim 5, wherein when the active control valve is closed, exhaust gas is exhausted through the first insert pipe, the first tube and the first tailpipe to the outside; and when the active control valve is opened, exhaust gas is exhausted through the first insert pipe, the first tube, the first tailpipe, the second insert pipe, the second tube and the second tailpipe to the outside.

7. The muffler assembly according to claim 1, wherein the active control valve is selectively opened and closed based on at least one of engine revolutions per minute (RPM), engine load, and vehicle speed determined by a controller.

8. The muffler assembly according to claim 7, wherein the active control valve is closed when the engine RPM is between a first predetermined RPM and a second predetermined RPM and the engine load is less than a predetermined engine load.

9. The muffler assembly according to claim 7, wherein the active control valve is opened when the engine RPM is less than a first predetermined RPM or greater than a second predetermined RPM.

10. The muffler assembly according to claim 7, wherein the active control valve is opened when the engine load is greater than a predetermined engine load.

* * * * *